US005839298A

United States Patent [19]

Duquet

[11] Patent Number: 5,839,298

[45] Date of Patent: Nov. 24, 1998

[54] DISPENSING AND DOSING DEVICE

[75] Inventor: Jacky Pierre Duquet, Herbeville, France

[73] Assignee: The Procter & Gamble Company, Cincinnati, Ohio

[21] Appl. No.: 737,941

[22] PCT Filed: Apr. 18, 1995

[86] PCT No.: PCT/US95/04695

§ 371 Date: Nov. 21, 1996

§ 102(e) Date: Nov. 21, 1996

[87] PCT Pub. No.: WO95/32329

PCT Pub. Date: Nov. 30, 1995

[30] Foreign Application Priority Data

May 21, 1994 [EP] European Pat. Off. ..... 94201439

[51] Int. Cl.[6] ..... D06F 39/02

[52] U.S. Cl. ..... 68/17 R; 68/235 R; 206/0.5; 222/105

[58] Field of Search ..... 8/158, 159; 18/17 R, 18/207, 235 R; 206/0.5; 222/105, 107

[56] References Cited

U.S. PATENT DOCUMENTS

| | | | |
|---|---|---|---|
| 1,983,691 | 12/1934 | Bonardi | 206/0.5 |
| 2,956,709 | 10/1960 | Nison et al. | 68/17 R |
| 3,240,567 | 3/1966 | Caparreli | 206/0.5 |
| 4,138,036 | 2/1979 | Bond | 222/105 |
| 4,211,156 | 7/1980 | Zimmermann | 206/0.5 |
| 4,532,722 | 8/1985 | Sax | 206/0.5 |
| 4,795,063 | 1/1989 | Sekiguchi et al. | 222/105 |
| 4,826,045 | 5/1989 | Price et al. | 222/105 |
| 4,921,131 | 5/1990 | Binderbauer et al. | 222/105 |
| 4,944,165 | 7/1990 | Leebeek et al. | 68/17 R |
| 4,969,927 | 11/1990 | Schumann et al. | 8/159 |
| 5,033,643 | 7/1991 | Schumacher | 222/52 |
| 5,139,168 | 8/1992 | Gueret | 222/105 |
| 5,156,300 | 10/1992 | Spahni et al. | 222/105 |
| 5,176,275 | 1/1993 | Bowie | 220/201 |
| 5,341,660 | 8/1994 | Berveglieri | 68/17 |
| 5,355,541 | 10/1994 | Rutter et al. | 8/158 |
| 5,388,298 | 2/1995 | Rutter et al. | 8/158 |

FOREIGN PATENT DOCUMENTS

| | | | |
|---|---|---|---|
| 114093 | 3/1918 | United Kingdom | 206/0.5 |
| 2255985 | 11/1992 | United Kingdom | 68/17 R |
| WO 89/09301 | 10/1989 | WIPO . | |
| WO 89/07685 | 12/1989 | WIPO . | |

OTHER PUBLICATIONS

European Patent Application 346, 113, Dec. 1989.

*Primary Examiner*—Frankie L. Stinson
*Attorney, Agent, or Firm*—Elizabeth M. Koch; E. Kelly Linman

[57] ABSTRACT

The present invention relates to a dosing and dispensing device for granular detergent. The device comprises a pliable bag-shaped sleeve and a maintaining means. The maintaining means plunges into the bag, of which one end is fastened in the region of the opening. Said maintaining means are collapsible and resilient. Therefore the dosing and dispensing device according to the present invention can be brought into a collapsed configuration.

18 Claims, 4 Drawing Sheets

DISPENSING AND DOSING DEVICE

FIELD OF THE INVENTION

The present invention relates to a dispensing and dosing device for granular detergent, said device being introduced with the laundry in the washing machine.

BACKGROUND OF THE INVENTION

Dispensing devices for granular detergents, which are to be introduced with the laundry in the washing machine, are well known in the prior art. One of the reasons these dispensing devices have been introduced is to increase the solubilization of high density granular detergents, so-called "compact" detergents. In fact, compact detergents dissolve poorely compared to regular detergents. One of the main benefits of using compact detergents is that a lesser amount of detergents are needed for a washing.

On top of the obvious environmental benefit, using smaller amounts of detergents for a wash cycle means that compact detergents can be packed in smaller packages. Smaller packages means less space needed for storage and transportation, therefore also logistic and cost improvements are achieved. However, including a dosing and dispensing device in said packages means that the volume occupied by said device has to be made available, instead of being occupied by a corresponding amount of detergent. Thus, part of the advantage resulting of compact granular detergents is lost when a dosing and dispensing device is included in the packages.

EP-A-0 343 069 describes a process of washing laundry in a machine with a bag-shaped dispensing device. Said device is made of a tissue-like material. The lack of elasticity of the tissue-like material requires the ttachement of a rigid frame inside the bag to prevent the collapsing and twisting of this tissue, as described in EP-A-0 343 070. Otherwise detergent can be trapped without dissolving in this twisted part. On the other hand said rigid frame needs an amount of volume which can not be reduced further. This illustrates the packaging space problem discussed hereinbefore. It is thus an object of the present invention to provide a dosing and dispensing device which solves this packaging space problem.

Furthermore, the tissue-like material is too pliant to allow a dosing of the detergent amount necessary for a wash cycle in the dispensing device itself. Therefore, an extra measuring scoop is also necessary. Said extra measuring scoop does not only increase furthermore the total cost and volume of this dispensing device kit comprising the dispensing device and the spoon, but makes also the exact measuring of the detergent difficult. It is therefore another object of the present invention to provide a dosing and dispensing device which allows an easy dosing without the need for an extra scoop.

A collapsible dispensing device for liquid detergents with a bellows-shaped wall is described in EP-B-0 288 347. The walls are made of a plastic material. Therefore, although this device collapses in the direction of the bellows, the wall does not deform perpendicular to this collapsing direction. We found that pliable walls can prevent that lumps of granular detergent can be formed onto the surface inside said device. These lumps are formed when said detergent contacts with water. Said lumps can eventually last through the whole wash cycle without being solubilized, therefore resulting in unnecessary residues and waste of detergent. It is therefore another object of the present invention to provide a collapsible and resilient dosing and dispensing device with pliable walls.

SUMMARY OF THE INVENTION

The present invention is a dispensing and dosing device for granular detergent. Said device comprises a pliable bag-shaped sleeve and maintaining means. Said sleeve extends around an opening which remains at least partially open during the washing. The maintaining means plunges into the bag, of which one end is fastened in the region of the opening. Said maintaining means are collapsible and resilient.

DETAILED DESCRIPTION OF THE INVENTION

In the following, "vertical" means a direction parallel to the longitudinal axis of the device (10), i.e. the perpendicular direction to the plane generally defined by the opening (18) of the device (10 ).

Figure 1:
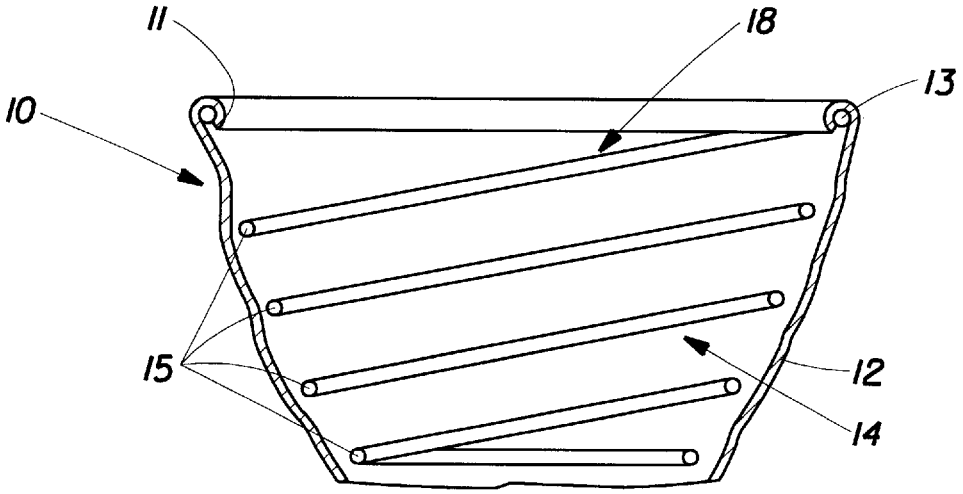
FIG. 1 shows cross sectional view of an embodiment of the dosing and dispensing device according to the present invention.

The preferred embodiment of the device used in accordance with the invention is shown in FIG. 1. Said device (10) mainly comprises a bagshaped, pliable sleeve (12) and resilient and collapsible maintaining means (14).

As a first essential feature, the device herein comprises a bag-shaped pliable sleeve (12). The material of said sleeve may be impermeable or not to water and to the washing medium. In the case of an impermeable bag, the transfers of fluid in the direction towards the inside and the outside of said bag, are made solely through the opening (18) of the bag. Said material of the bag-shaped sleeve has to be sufficiently resistant to the temperatures of the washing medium reached during the washing. The temperatures can be up to 95° C. Said material of the sleeve can be a woven or non-woven material made from natural or synthetic fibres or a mixtures of such fibres.

Purely by way of illustration, it is possible to use a sleeve consisting of pure cotton, in the form of a woven fabric having a mesh size smaller than 0.5 mm approximately. Said cotton can also be in the form of a non-woven article having apertures ranging in particular from 0.5 mm to 0.8 mm. Said bag may also be made from extruded or co-extruded films, provided with perforations. The dimensions of the perforations may vary within wide limits, depending on the nature and the particle size of the particulate product. As an indication, films having perforations of 380 $\mu$m may be used. However, the material of the bag is not obligatorily a textile material. The sleeve may also be made from a lattice of plastic material or from a sheet of paper or other porous, water resistant cellulosic material. If the material used for the bag does not itself have sufficient resistance to water, it may be provided with a coating making it water resistant. For example, in the case of porous paper, the coating may consist of a latex based binder associated with a hydrophobic substance.

As a second essential feature, the device herein comprises collapsible and resilient maintaining means. The simplest maintaining means is a spring (14), as illustrated in FIG. 1. Said spring can be replaced by any other elastic body or device that recovers its original shape when released after being distorted to accomplish the same functions of the maintaining means in the present invention. Said spring (14) makes the device (10) collapsible and resilient. Applying a vertical force, the spring (14) can be folded on itself till the spiral arms (15) are brought to the nearest possible position from each other. In the collapsed or flat configuration the vertical height of the device is reduced to a minimum which is also helped by the fact that the sleeve (12) is pliable.

To manufacture the device (10), the spring is first inserted inside the bag (12) and then the sleeve is attached to the spring. Preferably the attachment is made between the last top spiral arm (13) of said spring and the top portion (11) of said sleeve. The simplest attachment consists of glueing said top portion onto said last top spiral arm, or sewing said top portion around said last top spiral arm or a combination thereof.

In the preferred embodiment of the present invention the spring (14) stretches and maintains the sleeve in its maximum volume, i.e. the sleeve is not loose around the maintaining means (14). This allows a good measurement of the amount of granular detergent necessary for a wash cycle, since the stretched sleeve defines always a constant volume. The dosing lines may be on the outer and/or inner surface of the bag-shaped sleeve (12). Said dosing lines may be printed or indicated in some other manner. It is also possible to take the spiral arms (15) of the spring (14) as reference lines.

The spring (14) of the present invention is preferably made of elastomeric materials, such as polypropylene, polyethylene or polyesther. All these ensure enough compatibility with the wash solution and resistance to the temperatures mentioned above. However, a metal spring can also be considered, provided that it is stainless steel or it is protected by a layer of plastic on the outside. Also aluminum is a suitable material. The metal spring has the advantage that it allows an easier variation in shape of the spring itself. In FIGS. 4 to 7 are represented possible forms of the spring (14), plastic or metal. The form of the spring may be chosen by any person skilled in the art.

Through the opening (18) the dosing and dispensing device (10) is filled with the granular detergent. As discussed previously, in the case of an impermeable bag-shaped sleeve, the transfers of fluid and dissolved detergent in the direction towards the inside and the outside of said bag, are only possible through said opening (18). Therefore the opening (18) of the bag (12) has to be kept at least partially open during the washing to allow the progressive release of aqueous solution of granular detergent. The shape of said opening is preferably rounded to avoid to cause scratches in the fabrics through sharp edges. The last top spring arm is sufficiently resistant to have the device (10) serving also as a scoop. In this manner, by scooping with the device (10) it is possible to directly convey the granular detergent into the bag-shaped sleeve (12) without the need of an additional scooping device.

Figure 2:
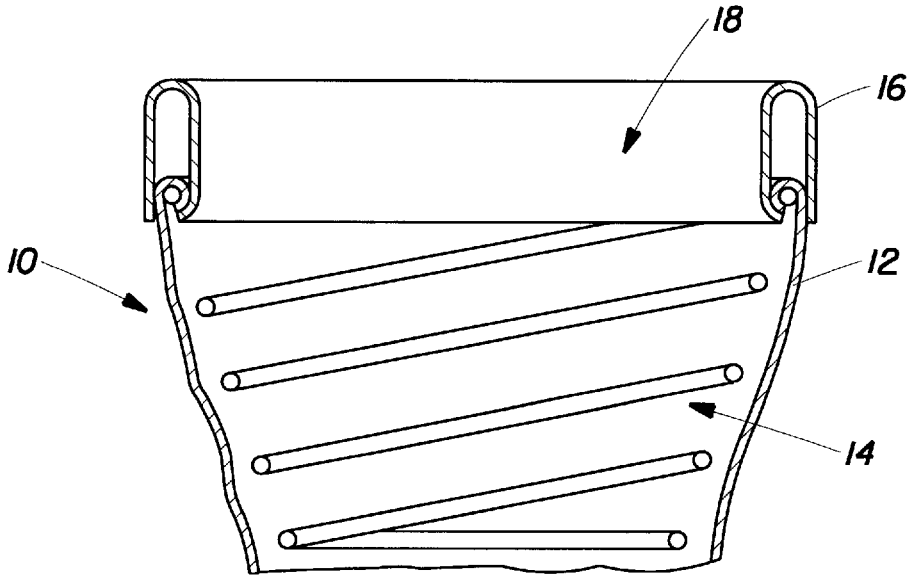
FIG. 2 shows a cross sectional view of another embodiment of the dosing and dispensing device according to the present invention.

As an optional, but preferred feature, a ring (16) is added around the opening (18) as shown in FIG. 2. This improves the before mentioned scooping of the detergent into said device (10). The ring (16) may be made of a material of widely varying hardness. The only conditions being that the opening (18) should be held open during the washing and that said ring resists at least at the same temperatures of the sleeve (12). The hardness of the ring (16) ensures that the lip of said ring is resistant enough to scoop the granular detergent inside the bag (12). The material of the ring (16) may be any water resistant material, withstanding also the temperatures reached in the washing and/or dryer machines. For example it is possible to use plastic, such as polyethylene and polypropylene, or also metallic materials.

Figure 3:
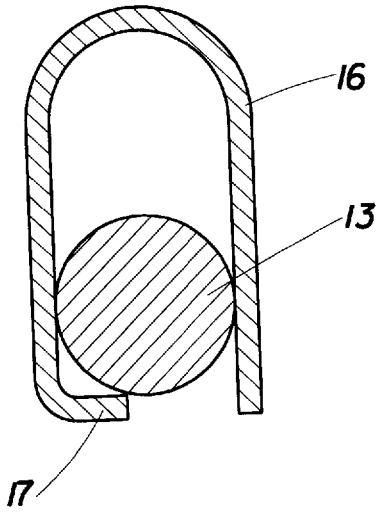
FIG. 3 illustrates the cross section of the ring (16) shown in FIG. 2.
Figure 4:
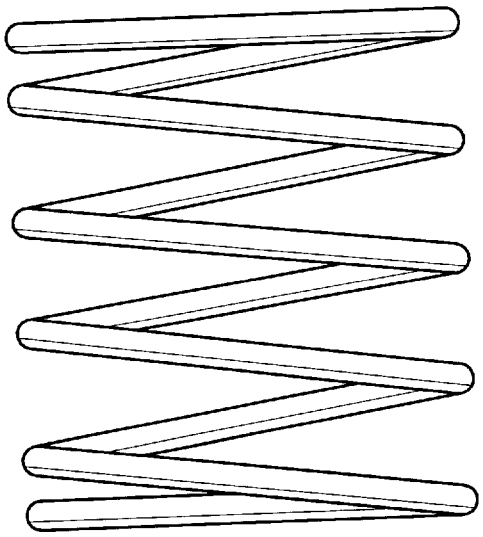
FIGS. 4 to 7 show various shapes of the maintaining means applicable to all embodiments of the dosing and dispensing device according to the present invention.
Figure 5:
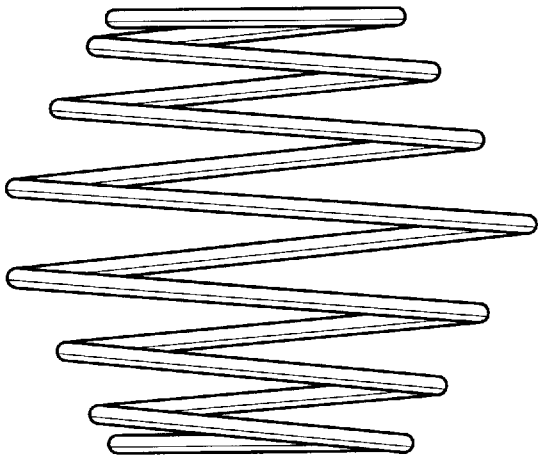
Figure 6:
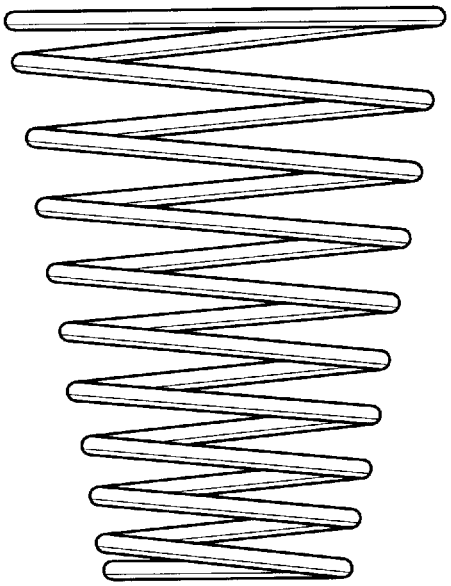
Figure 7:
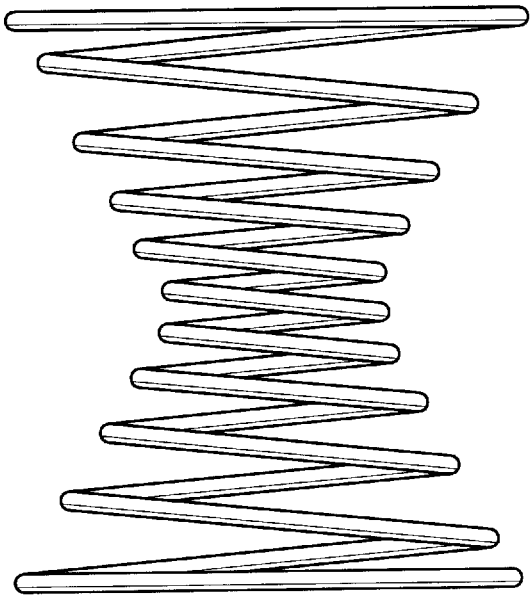

It is possible to use flexible, i.e. deformable and resilient, materials for the ring (16), but hard enough to allow the scooping. A deformable ring reduces the noise of the device (10) during the agitation in the drum of the washing machine. A resilient ring is to insure that the opening (18) is always held open as wide as possible during the washing. Such a material is, for example, polyurethane (PU) or other elastomers. The ring (16) may have any possible cross section, not only the preferred U-shaped one. This ring can also act as the sole attachment means between said sleeve and said maintaining means. The fastening of the spring (14) with the ring (16) is illustrated in FIG. 3 in a cross sectional view. The last top spiral arm (13) and the sleeve are inserted into the hollow ring (16) and held by the transverse portion (17) of said ring. The last top spiral arm is inserted by pushing into the hollow part of the ring using the elasticity of the material. Other possible execution of the holding of the sleeve and the spring inside the ring can be considered by any person skilled in the art.

Figure 8:
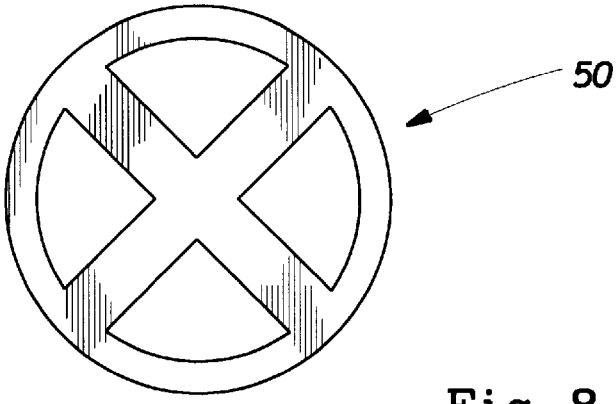
FIG. 8 to 10 show various examples of masks applicable to all embodiments of the present invention.
Figure 9:
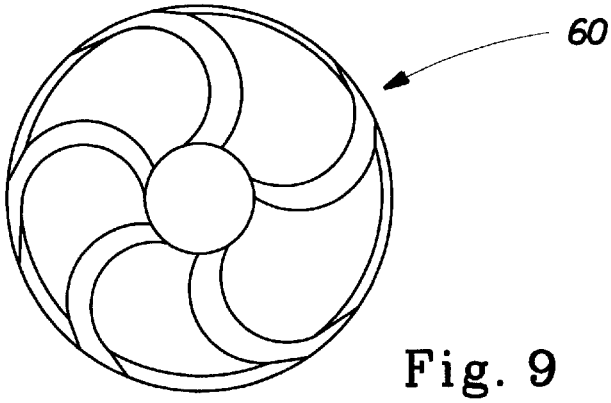
Figure 10:
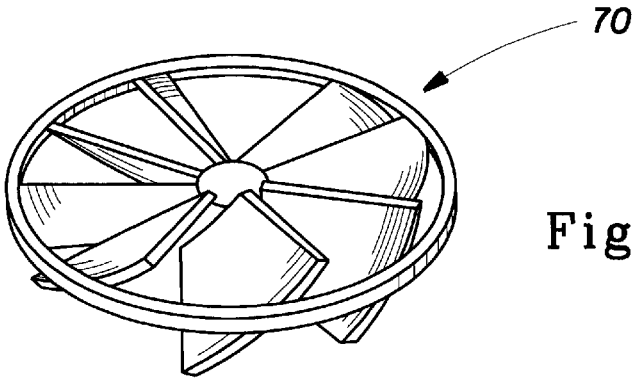

In another optional, but preferred embodiment of the present invention, the ring is provided also with means to mask the opening (18) apart from predetermined orifices which allow the filling and dispensing of the dosing and dispensing device. A top view of a mask (50) is shown in FIG. 8. Other examples are shown also in FIGS. 9 and 10. The impellers (72) of mask (70) are in a helical form. Indeed said masks ensure the filling of the bag (12) with the granular detergent and the access in the interior and the exit from the interior of the bag (12) of washing medium.

The advantage of the masks (50) to (70) resides in the fact that they cut in smaller pieces the lumps of granular detergent breaked up from the interior of the device (10) before said lumps get on the laundry during the wash cycle. This means, that these masks (50) to (70) further contribute to the better dissolution of the granular detergent in an aqueous medium.

All the embodiments of the dosing and dispensing devices described so far can be brought in a collapsed or flat configuration. The device (10) in the flat configuration has great logistic advantages. Granular detergents are supplied to the consumer in packages. These packages are usually cylindrical or rectangular canisters made of carton or plastic. Bags made of pliable material, like paper or plastified paper may also be used to contain granular detergent. Said bags containing compact detergent are small enough to be easily transported by the consumer without any need for cartons.

The flat configuration of the device (10) reduces to a minimum the space needed for a package comprising the detergent and the device (10). Said device (10) in collapsed configuration can be easily put onto or inside said packages. For example, the device (10) being in flat configuration can be fastened outside or put inside the package in a fastened manner to hold the flat configuration. Fastened in this manner, the dosing and dispensing device does not prevent a stable stacking of said packages. As a consequence, the packages comprising these devices have the same dimensions and occupy the same volume as those packages without said devices. Therefore, the packages containing the detergent together with the dosing and dispensing devices are not different from the packages containing only the refill of detergent. The logistic and cost problems deriving from a strict differentiation are completely solved. Also, the packagings will comprise a greater amount of detergent, for a given package volume.

Means to fasten the dispensing device (10) on the refill bags or to hold the dispensing device (10) itself in flat configuration, when put inside the refill bags, may be chosen by any person skilled in the art. For example, ligatures or adhesive tapes may be used. But also shrinkable plastic film are possible. These means are placed around the refill bags fastening the dispensing device (10) on top of said bag or directly around the dispensing device (10) to hold it in a collapsed configuration.

Another important advantage of the collapsibility and pliability of the device (10) is the avoidance of residues. The weight of the dry or wet laundry landing on said device (10) during the drying or washing cycle in the washing machine is sufficient to let said device (10) collapse and deform at least partially. Once the load is removed, said spring (14) recovers quickly its original shape. This compression/springback action during the wash cycle helps to break up lumps of detergent formed on the inside of the walls and therefore obtaining a more effective dissolution of the detergent in the wash cycle. The residues of detergent remaining after the wash process are therefore reduced to a minimum.

I claim:

1. A device for dosing and dispensing granular detergent compositions in a washing machine, said device comprising a pliable bag-shaped sleeve extending round an opening which remains at least partially open during the washing, and a maintaining means which plunges into the bag, of which one end is fastened in the region of said opening, wherein said maintaining means are collapsible and resilient.

2. A device according to claim 1 wherein said device resiliently collapses at least partially under the load of the laundry during the wash cycle.

3. A device according to claim 1 wherein said maintaining means stretches said sleeve to the maximum possible volume of said sleeve.

4. A device according to claim 1 wherein said maintaining means is a spring.

5. A device according to claim 4 wherein said spring is made of plastic.

6. A device according to claim 4 wherein said spring is made of metal completely covered with a layer of plastic.

7. A device according to claim 1 wherein said sleeve is made of a material capable of retaining a granular product, without allowing it to pass through it in solid form, and also of withstanding the temperatures up to 95° C. reached in the machine washing of laundry or in their drying.

8. A device according to claims 1, wherein said sleeve is made of a woven or non-woven material of natural fibres, such as cotton, or of synthetic fibres or mixtures of such fibres, or made from exruded or co-extruded films provided with perforations or from a lattice of plastic material or from a sheet of paper or other porous, water resistant cellulosic material.

9. A device according to claim 1 wherein the material of said sleeve is provided with a water resistant coating.

10. A device according to claim 1 wherein said device comprises a ring (16) around said opening (18).

11. A device according to claim 10 wherein the material of which the ring is made is a water resistant material withstanding the temperatures up to 95° C. reached in the machine washing of laundry or in their drying, particularly.

12. A device according to claim 10 wherein the ring is provided with masking means, said masking means covering the opening except for certain predetermined orifices.

13. A device according to claim 12 wherein said ring is flexible.

14. A package comprising a granular detergent and the dosing and a dispensing device according to claim 1 wherein said device is inside said package in a collapsed configuration, or said device is fastened on the outside said package in a collapsed configuration.

15. A package according to claim 14 wherein the fastening means are ligatures, adhesive tapes or shrinkable plastic films.

16. A package according to claims 14 wherein said package is stackable.

17. A package according to claim 14 wherein said package is selected from the group consisting of a plastic canister, a container made of paperboard and a bag made of pliable material.

18. A package according to claim 17 wherein said pliable material is paper or plastified paper.

* * * * *